US010068443B1

(12) United States Patent
Brooks et al.

(10) Patent No.: US 10,068,443 B1
(45) Date of Patent: Sep. 4, 2018

(54) SECURITY BARRIERS, SYSTEMS AND METHODS

(71) Applicant: Sandia Corporation, Albuquerque, NM (US)

(72) Inventors: Scott H. Brooks, Albuquerque, NM (US); Christian J. Hartwigsen, Albuquerque, NM (US)

(73) Assignee: National Technology & Engineering Solutions of Sandia, LLC, Albuquerque, NM (US)

( * ) Notice: Subject to any disclaimer, the term of this patent is extended or adjusted under 35 U.S.C. 154(b) by 120 days.

(21) Appl. No.: 15/043,983

(22) Filed: Feb. 15, 2016

Related U.S. Application Data

(60) Provisional application No. 62/121,313, filed on Feb. 26, 2015.

(51) Int. Cl.
*G08B 13/02* (2006.01)
*E01F 13/00* (2006.01)

(52) U.S. Cl.
CPC ..... *G08B 13/02* (2013.01); *E01F 13/00* (2013.01)

(58) Field of Classification Search
None
See application file for complete search history.

(56) References Cited

U.S. PATENT DOCUMENTS 3,395,569 A * 8/1968 Sheridan ..... G01L 1/16 73/35.16
2014/0033825 A1* 2/2014 Ravet ..... G01B 11/18 73/800

* cited by examiner

*Primary Examiner* — Joseph Feild
*Assistant Examiner* — John Mortell
(74) *Attorney, Agent, or Firm* — Daniel J. Jenkins

(57) ABSTRACT

Systems, arrangements, barriers and methods for detecting illicit attempts to compromise or penetrate a physical barrier are disclosed. The systems, arrangements, barriers and methods detect illicit attempts to pry, remove or compromise a security barrier from the surface or location it protects, by insider/outsider adversaries, when any type of cabled continuity sensor (optical, electrical) is woven, embedded, or interlaced through the security barrier.

20 Claims, 4 Drawing Sheets

SECURITY BARRIERS, SYSTEMS AND METHODS

CROSS-REFERENCE TO RELATED APPLICATIONS

This application claims priority to provisional patent applications U.S. Ser. No. 62/121,313, entitled "TAMPER DETECTION SYSTEM, BARRIER AND METHOD," by Brooks et al., filed Feb. 26, 2015, the disclosure of which is incorporated herein by reference in its entirety.

STATEMENT OF GOVERNMENT INTEREST

The United States Government has rights in this invention pursuant to Contract No. DE-AC04-94AL85000 between the United States Department of Energy and Sandia Corporation, for the operation of the Sandia National Laboratories.

FIELD

The present disclosure is generally directed to tamper detection. The present disclosure is more particularly directed to systems, barriers and methods for detecting illicit attempts to compromise or penetrate a physical barrier.

BACKGROUND

In order to illicitly remove access or compromise an object protected by a system of physical barriers, an adversary often must access a specific location on the physical barrier surface, from which the object will be removed, accessed or compromised. Often, these locations are protected by metal plates or security barriers that must be removed or penetrated in order to access the material beneath. In many cases, because of operational concerns or sensitivity of the device being protected, only an optical or other simple continuity sensor is allowed to be attached in the area of the security barrier. This causes a problem of how to ensure that a simple continuity sensor will detect attempts to remove the barrier.

The need remains, therefore, for systems, barriers and methods for detecting illicit attempts to compromise or penetrate a physical barrier.

SUMMARY OF THE DISCLOSURE

In an embodiment of the present invention, a barrier system is disclosed that includes a hasp attached to a base member, the hasp including a through passage, an outer member joined to the base member, and a sensor passing through the outer member and the hasp. The hasp is configured to deform or sever the sensor when the outer member is partially or completely separated from the base member.

According to another embodiment, a security arrangement is disclosed that includes a security enclosure including a barrier system. The barrier system includes a hasp attached to a base member, the hasp comprising a through passage, an outer member joined to the base member, and a sensor passing through the outer member and the hasp. The hasp is configured to deform or sever the sensor when the outer member is partially or completely separated from the base member.

According to another embodiment, a security barrier system is disclosed that includes a hasp attached to a base member, the hasp including a through passage, an outer layer joined to the base member, and a sensor passing or woven through the outer layer and the hasp, the sensor sensing a sensed condition. The hasp is configured to deform or severe the sensor to degrade, improve or otherwise cause a change in the sensed condition when the outer member moves relative to the base member.

According to another embodiment of the disclosure, a security arrangement is disclosed that includes a security enclosure surrounding an inside space and a security system. The security enclosure includes a barrier including a base member and an outer layer disposed upon the base member. The outer layer includes a passageway. The security enclosure is configured to prohibit access to the inside space. The security system includes a hasp attached to the base member. The hasp includes an aperture. The security system also includes a sensor passing or woven through the passageway in the outer layer and aperture of the hasp, the sensor sensing a sensed condition. The hasp is configured to deform or severe the sensor to degrade, improve or otherwise cause a change in the sensed condition when the outer member moves relative to the base member.

According to another embodiment of the disclosure, a method for monitoring an enclosure is disclosed that includes fastening a hasp having an aperture to a base member of a structure, covering the hasp with an outer layer, and passing a sensor through the outer layer and the aperture of the hasp. Prying, separating or partially separating the outer layer from the base member causes the hasp to deform or severe the sensor, thereby causing a change in a sensed condition of the sensor.

An advantage of the present disclosure is to provide systems, barriers and methods for passively detecting illicit attempts to compromise or penetrate a physical barrier.

Another advantage of the present disclosure is to provide a barrier system that includes a sensor covertly contained within the barrier system that remains covert or hidden and that is inaccessible without destroying the barrier and severing the continuity sensor.

Another advantage of the present disclosure is to provide a barrier system that cannot be penetrated without activating a covert sensor.

Other features and advantages of the present disclosure will be apparent from the following more detailed description of the preferred embodiment, taken in conjunction with the accompanying drawings which illustrate, by way of example, the principles of the disclosure.

BRIEF DESCRIPTION OF THE DRAWINGS

Wherever possible, the same reference numbers will be used throughout the drawings to represent the same parts.

DETAILED DESCRIPTION

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete and will fully convey the scope of the invention to those skilled in the art.

The present disclosure is directed to barriers, systems and methods for detecting illicit attempts to compromise or penetrate a physical barrier. The barriers, systems and methods detect illicit attempts to pry, penetrate, compromise or remove a security barrier from the surface or location it protects, by insider/outsider adversaries, when a sensor that is woven, embedded, or interlaced through the security barrier is deformed, severed, broken or sheared as a result of attempts to pry, penetrate, disassemble, compromise or remove the barrier. The sensor may be an electromagnetic, such as, but not limited to radio-frequency, electrical continuity, electrical resistance or conductance sensors, opto-electronic, such as, but not limited to fiber optic sensors, seismic, such as but not limited to vibration or impact sensors, acoustic, such as, but not limited to passive or active acoustic sensors, piezo-electric sensors, or fluid flow or pressure sensors. The barriers, systems and methods take advantage of the relative movement between the security barrier and the surface being protected, such that if any layer of the barrier is disassembled, removed, peeled or pried away from the surface it is meant to protect, the sensor or the sensor signal being monitored will be severed or deformed, resulting in detection.

Figure 1:
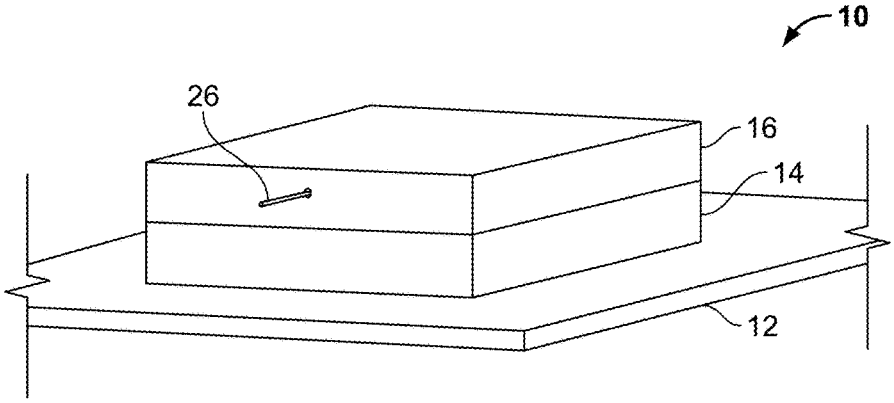
FIG. 1 is an illustration of a security barrier system according to an embodiment of the disclosure.

FIGS. 1, 2, 3 and 4 illustrate an embodiment of a security barrier arrangement, assembly or system 10 according to the disclosure. The system 10 provides a barrier to access against an intruder attempting to penetrate the barrier. As can be seen in FIG. 1, the security barrier arrangement or system (system) 10 includes a substrate or base structure, layer or member 12, an intermediate member or layer 14, and a sensor layer or an outer member or layer 16. The system 10 further includes a severing device or hasp 18 attached to the base member 12. In another embodiment, the intermediate layer 14 may be omitted. Also in this embodiment, the base, intermediate and outer layers 12, 14, 16 are shown as solid, homogeneous layers, however, in other embodiments, one or more of the base, intermediate and/or outer layers 12, 14, 16 may be formed of one or more layers or partial layers.

The base member 12 is a substrate or base structure, layer, barrier, wall, sheet or portion thereof, of an enclosure or partial enclosure of an asset to be protected, or a portion of the asset itself. In this exemplary embodiment, the base member 12 is a solid wall. In another embodiment, the base member 12 may be a wall or wall portion. In another embodiment, the base member may be solid or semi-solid. For example, a semi-solid base member may be, but is not limited to a grate or bar arrangement, which is to remain inaccessible except by removing the barrier. Also in this exemplary embodiment, the base member 12 has a uniform thickness, in other embodiments, the base member 12 may have a uniform or non-uniform thickness.

The intermediate layer 14 is a barrier, wall, sheet or structure or portion thereof, of an enclosure or partial enclosure of an asset to be protected. The intermediate layer 14 overlays and is in contact with the base member 12. In this exemplary embodiment, the intermediate layer 14 is a solid wall. In another embodiment, the intermediate layer 14 may be solid or semi-solid, such as a grate or bar arrangement, which is to remain inaccessible except by removing the barrier. In this exemplary embodiment, the intermediate layer 14 has a uniform thickness, in other embodiments, the intermediate layer 14 may have a uniform or non-uniform thickness. In this exemplary embodiment, the intermediate layer 14 is formed of a single layer. In another embodiment, the intermediate layer 14 may be formed of one or more layers formed of one or more materials. The intermediate layer 14 includes a through hole or passage 20 for allowing the hasp 18 to pass therethrough. The passage 20 allows the hasp 18 to extend from the base member 12, through the intermediate layer 14 and into the outer layer 16. The passage 20 is oversized for the hasp 18 by a space, interface or gap G (see FIG. 3).

The outer layer 16 is a barrier, wall or structure or portion thereof, of an enclosure or partial enclosure of an asset to be protected. In this exemplary embodiment, the outer layer 16 is a solid wall or wall portion. In another embodiment, the outer layer 16 may be solid or semi-solid, such as a grate or bar arrangement, which is to remain inaccessible except by removing the barrier. In this exemplary embodiment, the outer layer 16 has a uniform thickness, in other embodiments, the outer layer 16 may have a uniform or non-uniform thickness. In this exemplary embodiment, the outer layer 16 is formed of a single layer. In another embodiment, the outer layer 16 may be formed of one or more layers formed of one or more materials.

The outer layer 16 includes a bottom or inward facing surface 17 and an outer or outward facing surface 19. As used in this disclosure, the terms "inward" and "inward facing" mean the surface facing in the direction of the inside space 816 of the enclosure 810 (see FIG. 8). The outer layer 16 includes a cavity or recess 22 that extends from a bottom surface 17 into the outer layer 16. The recess 22 does not extend through the hasp 18 to the outward facing surface 19. The recess 22 receives a portion of the hasp 18, or in other words, a portion of the hasp is disposed in the recess 22. In such a manner, the hasp 18 is not observable to an observer viewing the outside surface 19. The recess 22 is oversized for the hasp 18 by a space, interface or gap G'.

Figure 3:
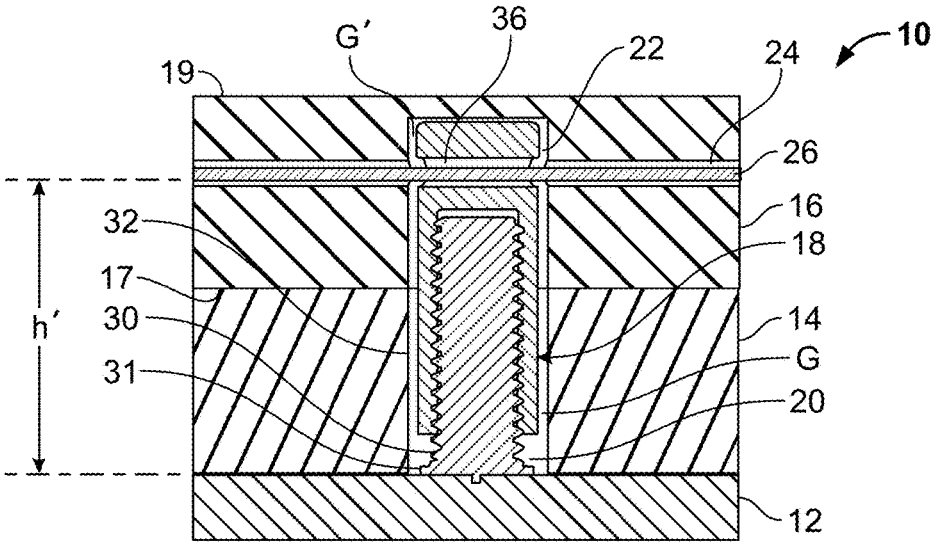
FIG. 3 illustrates a partial cross sectional view of FIG. 1.
Figure 4:
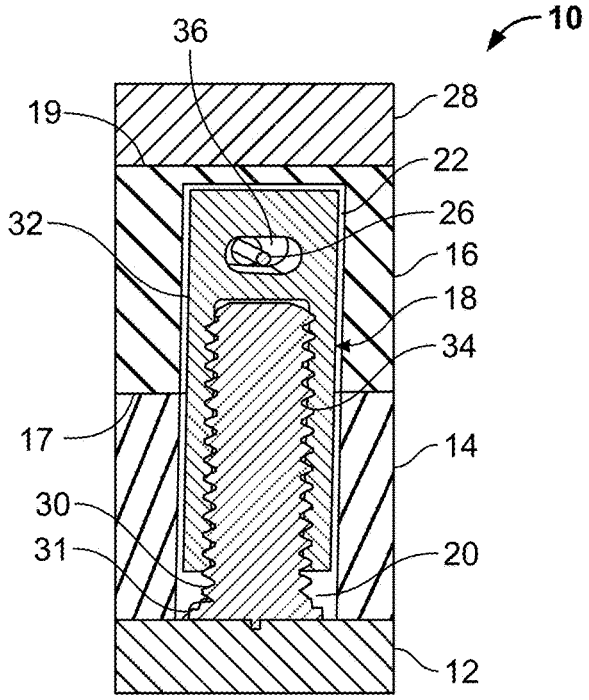
FIG. 4 illustrates another partial cross sectional view of an embodiment of FIG. 1.

The outer layer 16 also includes a conduit or passage 24 that extends across and/or through at least a portion of the outer layer 16 and through the recess 22. The passage 24 may be referred to as the sensor passage. The passage 24 allows for a sensor 26 to pass through or be woven through at least a portion of the outer layer 16 and through the hasp 18 as shown in FIGS. 3 and 4. In another embodiment, one or more passages may be woven into the outer layer 16 to that one or more ends of the one or more passages are accessed by the inward and/or outward facing surfaces 17, 19.

The base member 12, intermediate layer 14, outer layer 16 and hasp 18 may be formed of a barrier material, such as, but not limited to metals, ceramics, cermets, organic structural materials and combinations thereof. The metal may be, but is not limited to steels and other alloys such as stainless steel, and other metals such as aluminum, copper, zinc, brass, lead, or titanium. The ceramic may be, but is not limited to cements, metal oxides such as, but not limited to tungsten carbide. The cermet may be, but is not limited to metal oxides in metal matrix. The organic materials may be, but are not limited to wood, wood composites, plastics, polymers, epoxies or combinations thereof. In this exemplary embodiment, the base member 12, intermediate layer 14, outer layer 16 and hasp 18 are formed of a homogenous, single material. In other embodiments, the base member 12, intermediate layer 14, outer layer 16 and hasp 18 may be formed of one or more materials.

In this exemplary embodiment, the sensor 26 is a fiber carrying a visible, electromagnetic (EM) or light beam or transmission in the visual wavelength. In another embodiment, the EM transmission may be a non-visible EM beam, such as, but not limited to infrared (IR), and radio-frequency (RF). In yet another embodiment, the sensor 26 may be a wire, cable, fiber or conduit capable of transmitting or carrying an electric current or electromagnetic (EM) transmission, an acoustic signal, or fluid. In an embodiment, the sensor 26 may be an optical cable or conduit, such as, but not limited to a fiber optic cable, light pipe or waveguide. In another embodiment, the sensor 26 may be a wire, cable, fiber or conduit capable of providing electrical conductive or continuity. For example, the sensor 26 may be a metal or metal alloy wire, cable, fiber or conduit. In another embodiment, the sensor 26 may be a conduit, pipe, or pressure vessel that provides for a flow or containment of a gas or liquid fluid. In such a manner the sensor 26 may be tested or monitored for changes in electrical continuity, resistance and/or conductance; optical transmission; and changes in fluid pressure. In another embodiment, the sensor may be selected from a group including electromagnetic, such as, but not limited to radio-frequency, electrical continuity, electrical resistance or conductance sensors, opto-electronic, such as, but not limited to fiber optic sensors, seismic, such as but not limited to vibration or impact sensors, acoustic, such as, but not limited to passive or active acoustic sensors, piezo-electric sensors, fluid flow or pressure sensors and combinations thereof. In another embodiment, the sensor 26 and routing path or passage 24 are created in tandem using an additive manufacturing process, such as but not limited to 3-D printing, resulting in one of the sensor configurations discussed herein.

In FIG. 4, the system 10 is shown including an optional cover member or cap or cover layer 28. In this exemplary embodiment, the cover layer 28 is a single layer. In another embodiment, the cover layer 28 may be formed of one or more layers formed of one or more materials discussed above in discussing the base, intermediate and/or outer layers 12, 14, 16.

Referring to FIGS. 3-4, the hasp 18 includes a base portion, bottom portion or base 30 and a top or cap portion or cap 32. The base 30 and cap 32 include corresponding threaded ridges and grooves 33, 34 that allow for base and cap 30, 32 to be connected or joined. The threads 33, 34 allow for the height H of the hasp 18 to be adjusted. In such a manner the height H of the hasp 18 above or protruding from the base member 18 can be adjusted. In another embodiment, the base and cap 30, 32 may be joined by other joining systems or methods, such as, but not limited to press fit and fasteners that may or may not allow for the height of the hasp to be adjusted. The height H of the hasp 18 may be fixed after adjusting the height H by a fixing method, such as, but not limited to welding, brazing, gluing or by the use of a fastener or pin In another embodiment, the hasp 18 may be formed of a single portion, such that the height H is fixed. The base 30 also includes a base plate 31 at one end, which functions as an interface with base member 12. In other embodiments, the base plate 31 may be omitted.

The hasp 18 is attached to the base member 12 by attaching the base plate 31 of the base 30 to the base member 12. In this exemplary embodiment, the hasp 18 is attached to the base member 12 by welding. In another embodiment, the hasp 18 may be attached to the base member 12 by any other joining technique, such as, but not limited to brazing, welding, press fit and gluing. In another embodiment, the hasp 18 may be attached to the base member by another attachment method or technique, such as by threading or mechanical fastening. In another embodiment, the hasp 18 may be machined onto or into the surface of the base member 12.

The cap 32 includes a through hole or passage 36. As discussed above in regard to the height H of the hasp 18, the height h of the passage may be similarly adjusted. In such a manner, the height h of the passage above the base member 12 may be adjusted such that the height h is approximately the same or the same as the height h' of the passage 14 above the base member 12 (see FIG. 3). The passage 36 allows the sensor 26 to pass through the hasp 18.

The system 10 is arranged such that relative movement between the outer layer 16 and the hasp 18 will severe, shear or deform the sensor 26 at the hasp 18, thereby causing a change in a measured property or characteristic of the sensor 26, such as a change in the electrical continuity, electrical resistance, electrical current transmission, optical transmission, or fluid transmission or pressure. In an embodiment, the relative movement may be, but is not limited to sliding, prying separating or partially separating the outer layer 16 from the intermediate layer 14 and/or the intermediate layer 14 from the base member 12. It is understood that relative movement between the intermediate layer 14 and the base member 12 necessarily creates movement between the outer layer 16 and the base member 12. For example, the relative movement may be greater than 0.15 D and less than 1.0 D, where D refers to the minor diameter of the sensor 26. In another embodiment, D refers to the minor diameter or width of the physical sensor passage 24 in the outer barrier layer 16 in which the sensor is routed, embedded, encased, or woven.

Figure 5:
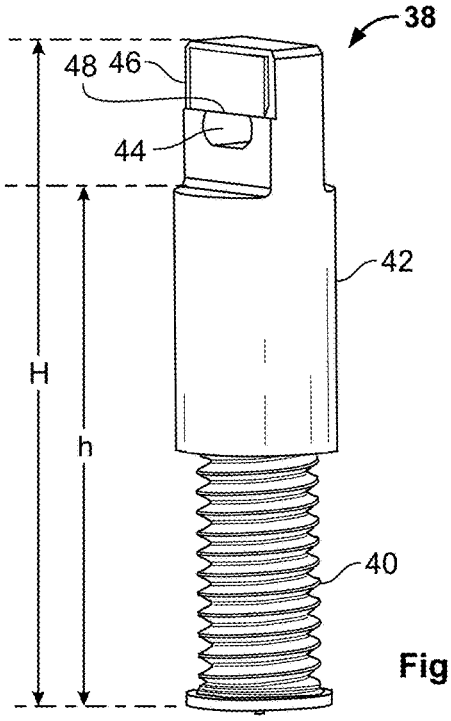
FIG. 5 illustrates another embodiment of a hasp according to the disclosure.
Figure 6:
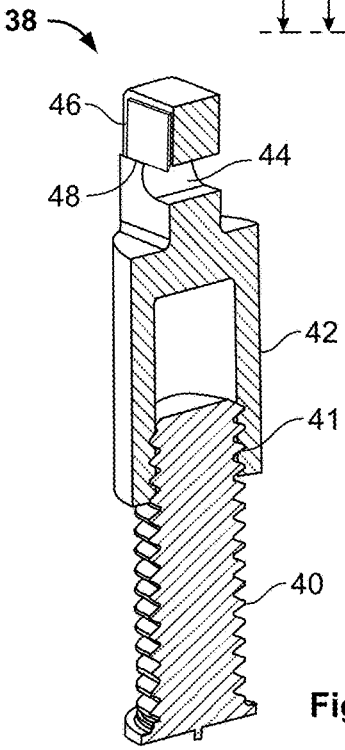
FIG. 6 illustrates a cross sectional view of the hasp of FIG. 5.

FIGS. 5 and 6 illustrate another embodiment of a hasp 38 according to the present disclosure. As can be seen in FIGS. 5 and 6, the hasp 38 includes a base 40 and a cap 42. The cap 42 includes a passage 44. In this exemplary embodiment, the hasp 38 further includes an edged component or cutter 46. The cutter 46 includes an edged portion or protrusion 48 for facilitating mechanical severing, shearing or deforming of the sensor 26. As discussed above in the embodiment shown in FIGS. 2-4, threads 41 may be used to adjust heights H and h.

Figure 7:
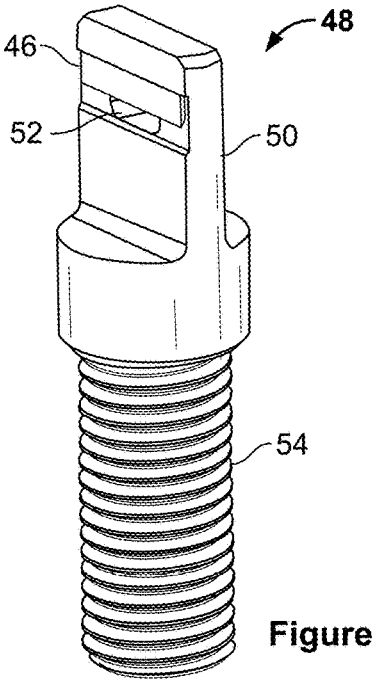
FIG. 7 illustrates another embodiment of a hasp according to the disclosure.

FIG. 7 illustrates another embodiment of a hasp 48 according to the disclosure. In this exemplary embodiment, the hasp 48 is formed of a single unit or body 50 having a through hole or passage 52. The hasp 48 includes threads 54 that allow for the hasp to be threaded into a receiving threaded hole in a base member (not shown). In another embodiment, the hasp 48 may be fastened to a base member by another joining means, such as, but not limited to welding, brazing, gluing, by the use of fasteners or pins or combinations thereof.

The interface or gap G' between the hasp 18 and the outer layer 16 should be very small to facilitate sheering of the sensor (see FIG. 3). In an embodiment, the gap G' may be between an interference fit or friction fit between the outer member and the hasp up to the diameter of the sensor. In an embodiment, the gap G' may be between 0.1 mm and 5 mm. In an embodiment, the interface may be between 0.5 mm and 4 mm. In an embodiment, an gap G' of between 4 mm and 5 mm is preferred to allow some movement of the outer member during a pry attack to eliminate any side forces on the stud or threaded portion of the hasp 18 that may cause the hasp 18 to separate from the surface being protected prior to the hasp sheering action occurring. Testing has shown that a taut sensor may not be as important to cutting performance, when the gap G' is very small, with very small being defined as <0.5 D. In an embodiment, the gap G' between the hasp 18 and the outer layer 16 is greater than 0.1 D and less than 0.6 D. In an embodiment, the gap G between the hasp 18 and the intermediate layer 14 may be the same or different than the gap G' between the hasp 18 and the outer layer 16.

Figure 8:
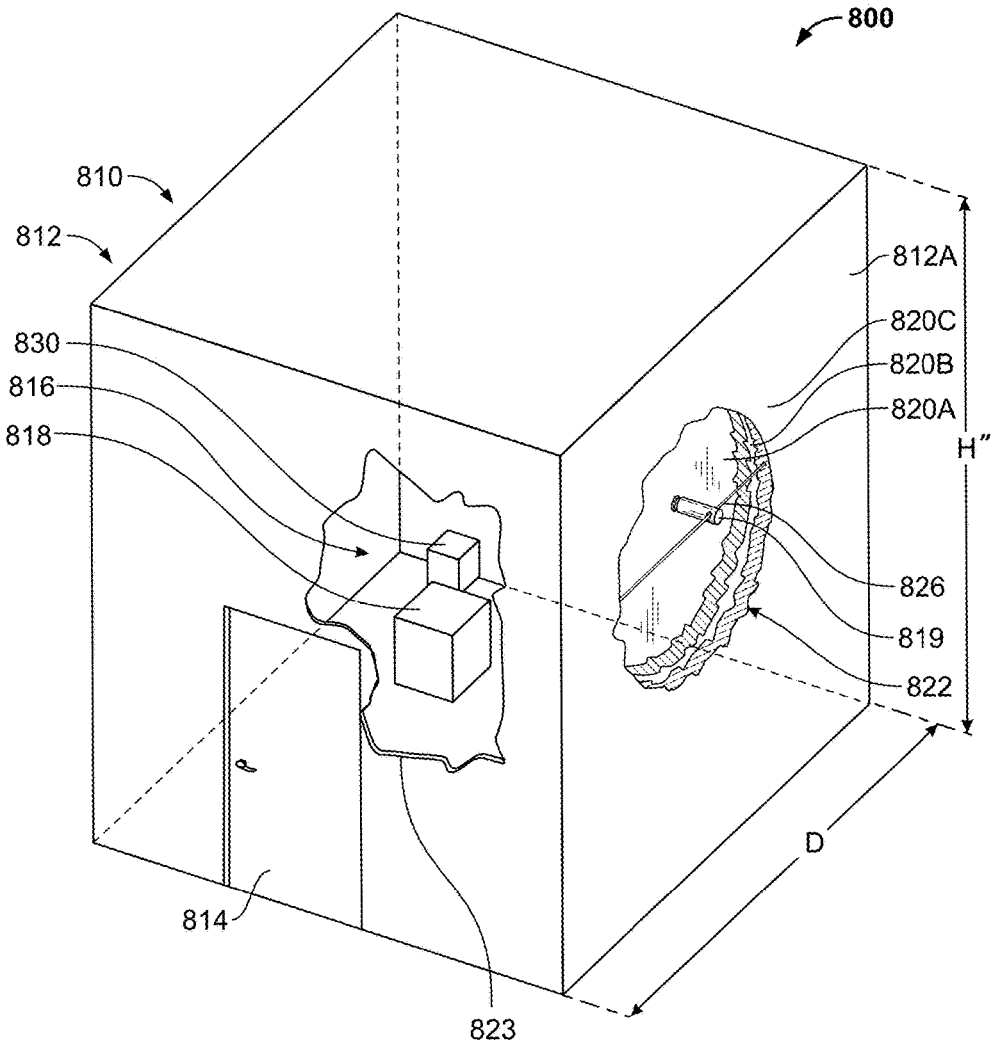
FIG. 8 illustrates an embodiment of an enclosure having a security system according to an embodiment of the disclosure.

FIG. 8 illustrates an intrusion prevention or security system (system) 800 according to an embodiment of the present disclosure. In this exemplary embodiment, the system 800 is applied to or implemented on an enclosure 810. The enclosure 810 includes a plurality of walls or barriers 812 enclosing or partially enclosing a contained or inside space 816. The enclosure 810 also includes an access structure or door 814 for providing access to a high value object (object) 818 that is secured within the enclosure 810 in the inside space 816. The plurality of barriers 812 include at least one wall or barrier 812A having a portion of a security barrier or system (system) 800 disposed therewithin. The at least one barrier 812A includes a base member 820A, an intermediate layer 820B and an outer layer 820C, arranged similarly to the embodiment of members and layers shown in FIGS. 1-3.

As can be seen in FIG. 8, the system 800 includes one or more hasps 819, one or more sensors 826, and a monitoring system 830. In FIG. 8, a portion 822 of the intermediate and outer layers 820B, 820C have been removed to allow for viewing of one hasp 818. The one or more hasps 818 are attached to the base member 820A. In this exemplary embodiment, the base member 820A is a base layer or sheet of metal that covers the inside surface (the surface facing the inside of the enclosure) of the at least one barrier 812A, or in other words, the inside of the wall 812A. Also in this exemplary embodiment, the one or more hasps 818 are disposed in a plurality of horizontal rows and vertical columns of hasps spaced along the depth D and height H" of the at least one barrier 812A (not shown are the other rows and columns of hasps that are covered by an outer layer). In other embodiments, the plurality of haps 18 may be one or more hasps disposed in one or more columns and/or rows.

Figure 2:
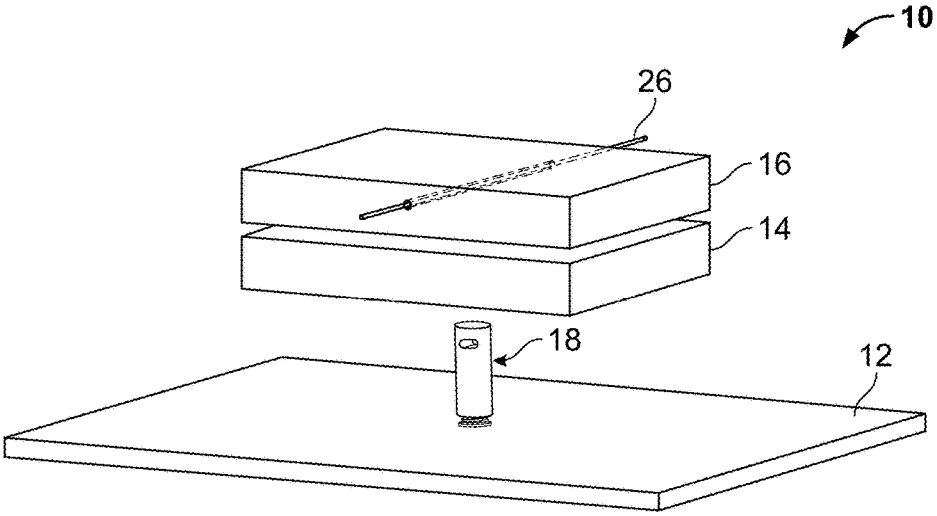
FIG. 2 illustrates a partially exploded view of FIG. 1.

Sensor 826 passes through passages (not shown) in the outer layer 820C, similar to the arrangement shown in FIGS. 1-3. As can be appreciated, the one or more hasps 818 and sensors 826 are covered by the outer layer 820C such that the one or more hasps 818 and one or more sensors 826 are not visible or observable to an observer looking upon the outer layer 820C.

The plurality of sensors 826 are connected to the monitoring system 830. The monitoring system 830 monitors one or more sensed conditions from one or more sensors for changes to one or more associated sensed conditions. If the monitored sensed condition is outside of a predetermined range, the monitoring system 830 initiates an action, such as displaying and/or sending an alert or alarm signal. The alarm signal may be in the form of, but not limited to a visual, audible, message signal, and combinations thereof. The alarm signal may be relayed or transmitted by wire or wirelessly to a monitoring station (not shown). The monitoring station may be co-located or remote to the monitoring system.

The plurality of sensors 826 may be directly or indirectly connected to the monitoring system 830 by wired or wireless connections, such that the monitoring system 830 can monitor the sensors 826 for a change in one or more sensed characteristics, such as described above. In the system 800 shown in FIG. 8, separating, partially separating or deforming the intermediate and/or outer layers 820B, 820C causes a change in the sensed condition of the one or more sensors 826, the change observed by the monitoring system 830, which then triggers an alarm.

The disclosure is further directed to methods for sensing an intrusion. In an embodiment, the method includes fastening a hasp to a base member of a structure, covering the hasp with an outer layer that has a sensor passing through, woven in or embedded in the outer layer that also passes through an opening, aperture or through hole in the hasp. Creating relative movement between the outer layer and thee base member by sliding, prying, separating or partially separating the outer layer from the base member causes the hasp to deform or severe the sensor, thereby causing a change in one or more sensed conditions. In an embodiment, the structure may also include one or more intermediate layers between the base member and the outer layer. The method may further include the sensed condition being monitored by a monitoring system that provides for an alarm or warning if the sensed condition varies from a predetermined acceptable range, and for providing the alarm to a co-located or separately located monitoring station. Various embodiments of the structure, hasp, sensor, sensed conditions and sensor system are as further described in various paragraphs in this disclosure.

The invention being thus described, it will be obvious that the same may be varied in many ways. Such variations are not to be regarded as a departure from the spirit and scope of the invention, and all such modifications as would be obvious to one skilled in the art are intended to be included within the scope of the appended claims. It is intended that the scope of the invention be defined by the claims appended hereto. The entire disclosures of all references, applications, patents and publications cited above are hereby incorporated by reference.

In addition, many modifications may be made to adapt a particular situation or material to the teachings of the disclosure without departing from the essential scope thereof. Therefore, it is intended that the disclosure not be limited to the particular embodiment disclosed as the best mode contemplated for carrying out this disclosure, but that the disclosure will include all embodiments falling within the scope of the appended claims.

What is claimed is:

1. A security harrier system, comprising:

a hasp attached to a base member, the hasp comprising a through passage;

an outer layer joined to the base member; and a sensor passing or woven through the outer layer and the through passage of the hasp, the sensor sensing a sensed condition;

wherein the hasp is configured to deform or sever the sensor to degrade, improve or otherwise cause a change in the sensed condition when the outer member moves relative to the base member; and wherein the sensor is selected from a group consisting essentially of a wire, cable, fiber and conduit.

2. The barrier system of claim 1, further comprising:

one or more intermediate layers disposed between the outer layer and the base member.

3. The barrier system of claim 1, wherein the sensed condition is selected from a group consisting of an electromagnetic condition, an opto-electric condition, a seismic condition, an acoustic condition, and fluid pressure condition.

4. The barrier of claim 3, wherein the electro-magnetic condition is selected from a group consisting of electrical conductivity, electrical resistance and electrical continuity.

5. The barrier system of claim 1, wherein the sensor is a fiber optic cable.

6. The barrier system of claim 1, wherein the sensor is an electrically conductive wire or cable.

7. The barrier system of claim 1, further comprising:

a cap layer disposed over the outer layer.

8. A security arrangement, comprising:

a security enclosure surrounding an inside space, the security enclosure comprising:

a barrier comprising:

a base member; and an outer layer disposed upon the base member, the outer layer comprising a passageway;

wherein the security enclosure is configured to prohibit access to the inside space; and a security system comprising:

a hasp attached to the base member, the hasp comprising an aperture; and a sensor passing or woven through the passageway of the outer layer and aperture of the hasp, the sensor sensing a sensed condition;

wherein the hasp is configured to deform or severe the sensor to degrade, improve or otherwise cause a change in the sensed condition when the outer member moves relative to the base member; and wherein the sensor is selected from a group consisting essentially of wire, cable, fiber and conduit.

9. The security arrangement of claim 8, wherein the barrier further comprises one or more intermediate layers disposed between the outer layer and the base member.

10. The security arrangement of claim 8, wherein the sensed condition is selected from a group consisting of an electro-magnetic condition, an opto-electric condition, a seismic condition, an acoustic condition, and fluid pressure condition.

11. The security arrangement of claim 10, wherein the electro-magnetic condition is selected from a group consisting of electrical conductivity, electrical resistance and electrical continuity.

12. The security arrangement of claim 8, wherein the sensor is a fiber optic cable.

13. The security arrangement of claim 8, wherein the sensor is an electrically conductive wire or cable.

14. The security arrangement of claim 8, wherein the barrier further comprises a cap layer disposed over the outer layer.

15. A method for monitoring an enclosure, comprising:

fastening a hasp having an aperture to a base member of a structure;

covering the hasp with an outer layer; and passing a sensor through the outer layer and the aperture of the hasp; wherein prying, separating or partially separating the outer layer from the base member causes the hasp to deform or severe the sensor, thereby causing a change in a sensed condition of the sensor;

wherein the sensor is selected from a group consisting essentially of a wire, cable, fiber and conduit.

16. The method of claim 15, wherein the sensed condition is selected from a group consisting of an electro-magnetic condition, an opto-electric condition, a seismic q condition, an acoustic condition, and fluid pressure condition.

17. The method of claim 15, further comprising:

alerting a user to the change in the sensed condition of the sensor.

18. The method of claim 16, wherein the electro-magnetic condition is selected from a group consisting of electrical conductivity, electrical resistance and electrical continuity.

19. The method of claim 15, wherein the sensor is a cable, and the cable is a fiber optic cable.

20. The method of claim 15, wherein the sensor is a wire or cable, and the wire or cable is a conductive wire or cable.

* * * * *